US007021095B2

(12) United States Patent
Jensen

(10) Patent No.: US 7,021,095 B2
(45) Date of Patent: Apr. 4, 2006

(54) APPARATUS AND METHOD FOR CONTROLLING ACCESS TO STORED KEYS

(76) Inventor: Hans C. Jensen, 961 - 1959 Marine Drive, North Vancouver, British Columbia (CA) V7P 3G1

( * ) Notice: Subject to any disclaimer, the term of this patent is extended or adjusted under 35 U.S.C. 154(b) by 0 days.

(21) Appl. No.: 10/869,937

(22) Filed: Jun. 18, 2004

(65) Prior Publication Data

US 2005/0279145 A1 Dec. 22, 2005

(51) Int. Cl.
*E05B 11/00* (2006.01)

(52) U.S. Cl. ..... 70/389; 70/386; 70/388; 70/408; 70/429; 70/459; 70/460; 70/DIG. 63

(58) Field of Classification Search ..... 70/386, 70/389, 429, 430, 456 R, 459, 460, 390, 70/388, 414, 441, 61, 63, DIG. 63, 408, 337–339
See application file for complete search history.

(56) References Cited

U.S. PATENT DOCUMENTS

| | | | | | |
|---|---|---|---|---|---|
| 2,116,965 | A | * | 5/1938 | Schoorel et al. | 70/38 A |
| 3,575,024 | A | | 4/1971 | Schlage | 70/389 |
| 3,855,824 | A | | 12/1974 | Falk | 70/38 A |
| 4,069,696 | A | * | 1/1978 | Steinbach | 70/491 |
| 4,337,987 | A | * | 7/1982 | Brooks et al. | 312/219 |
| 4,416,413 | A | * | 11/1983 | Chester | 232/24 |
| 4,472,952 | A | | 9/1984 | Hollowell, Jr. | 70/61 |
| 4,631,941 | A | | 12/1986 | Sjunnesson | 70/337 |
| 4,641,509 | A | | 2/1987 | Batchelor et al. | 70/388 |
| 4,753,092 | A | | 6/1988 | Mercer | 70/389 |
| 5,020,347 | A | * | 6/1991 | Logan | 70/389 |
| 5,063,761 | A | * | 11/1991 | Ling | 70/25 |
| 5,361,614 | A | | 11/1994 | Metcalf | 70/389 |
| 5,372,021 | A | | 12/1994 | Smith | 70/63 |
| 5,505,066 | A | | 4/1996 | Baucom | 70/389 |
| 5,878,613 | A | | 3/1999 | Tabacchi et al. | 70/389 |
| 5,896,761 | A | * | 4/1999 | Chen | 70/38 A |
| 6,026,663 | A | * | 2/2000 | Tsung-Chuan et al. | 70/39 |
| 6,038,898 | A | * | 3/2000 | Cliff | 70/491 |

FOREIGN PATENT DOCUMENTS

| | | | |
|---|---|---|---|
| RU | 442609 | * | 8/1975 |

* cited by examiner

*Primary Examiner*—Lloyd A. Gall
(74) *Attorney, Agent, or Firm*—Oyen Wiggs Green & Mutala

(57) ABSTRACT

A system and apparatus for controlling keys or other objects is provided. The key can only be removed when an access control key identifying the individual who is removing the key is inserted. The access control key cannot be removed until the key is returned.

8 Claims, 9 Drawing Sheets

APPARATUS AND METHOD FOR CONTROLLING ACCESS TO STORED KEYS

TECHNICAL FIELD

The invention relates to the field of devices for storing keys and managing and controlling access to the keys.

BACKGROUND

In various situations such as vehicle dealerships, vehicle rentals, equipment rentals, vehicle repair shops and the like, numerous keys are being held at any given time. It is important to control access to such keys so that only authorized individuals may remove the keys and also to be able to identify which individual has possession of a particular key at any given time.

A number of systems have been patented in the area of devices for controlling access to stored keys in which a master key is used to release the subject key or article. U.S. Pat. No. 4,472,952 Hollowell, Jr. discloses a system for the management of the issuance and return of articles such as keys, tools and the like. It uses a master unlocking key to engage a geared locking bar which then frees the locking key attached to the article and locks the master key in the device. The master key is released when the locking key is re-inserted into the device and turned to cause a gear to move the geared locking bar to the original position. U.S. Pat. No. 4,641,509 Batchelor et al. discloses a system for retaining and controlling keys in which a universal key turns a lug which engages a notch in the subject key to retain it or release it when the universal key is returned to its original position. In this system the subject keys must be notched by a grinder in order for the system to work. U.S. Pat. No. 5,505,066 Baucom discloses a device for alternately locking a selected one of a pair of keys and releasing the other key for removal from the device. It uses a visitor key having a geared end which engages a geared slider and moves the slider when the visitor key is rotated to alternately release the home key and secure the visitor key or secure the home key and release the visitor key. A system of cams and pins prevents the visitor key from being removed when the home key is removed and vice versa.

U.S. Pat. No. 5,372,021 Smith discloses a key control device which uses a primary key and lock and a secondary key and lock. The cylinders of the two locks are interconnected by a tie rod or gears such that insertion of one of the two keys frees the second key and retains the first key, and vice versa. U.S. Pat. No. 5,878,613 Tabacchi et al. discloses a key control device which uses an access key and lock and a stored key and lock. Rotation of the keys rotate cams which engage with a lid whereby only one key can be removed at any time and removal of one key prevents removal of the other key.

SUMMARY OF INVENTION

The invention provides a key control apparatus comprising: a plurality of key control units; a plurality of key holding elements each adapted to have a key attached to it; a plurality of access control elements; each control unit having a passage for alternately receiving a unique one of said key holding units and a passage for receiving any one of said access control elements; whereby said key control element can be removed by inserting any of one of the access control elements into said passage but said access control element can only be removed when said unique corresponding key holding element is inserted into said control unit.

BRIEF DESCRIPTION OF DRAWINGS

In drawings which illustrate a preferred embodiment of the invention

DESCRIPTION

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Figure 1:
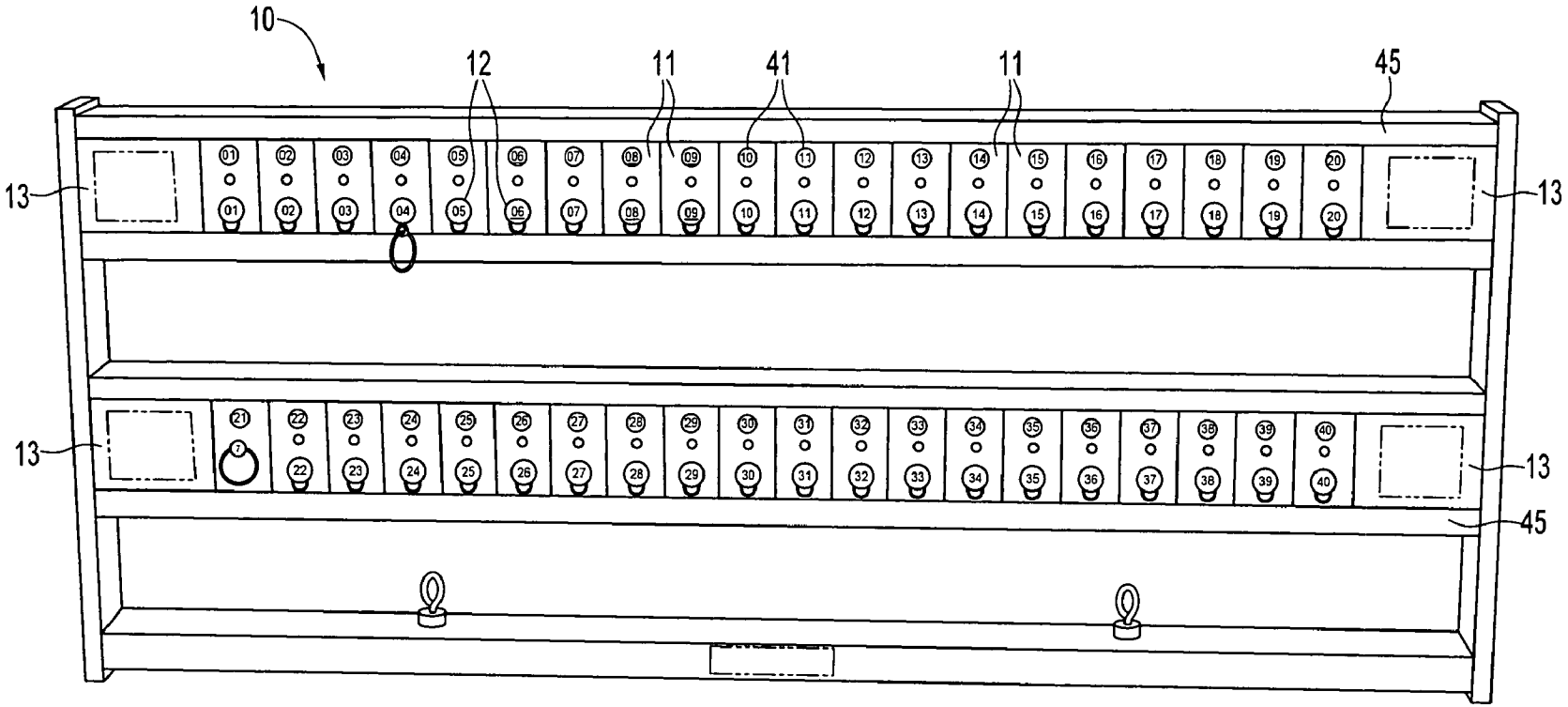
FIG. 1 is a front view of a key control and storage cabinet according to the invention.
Figure 2:
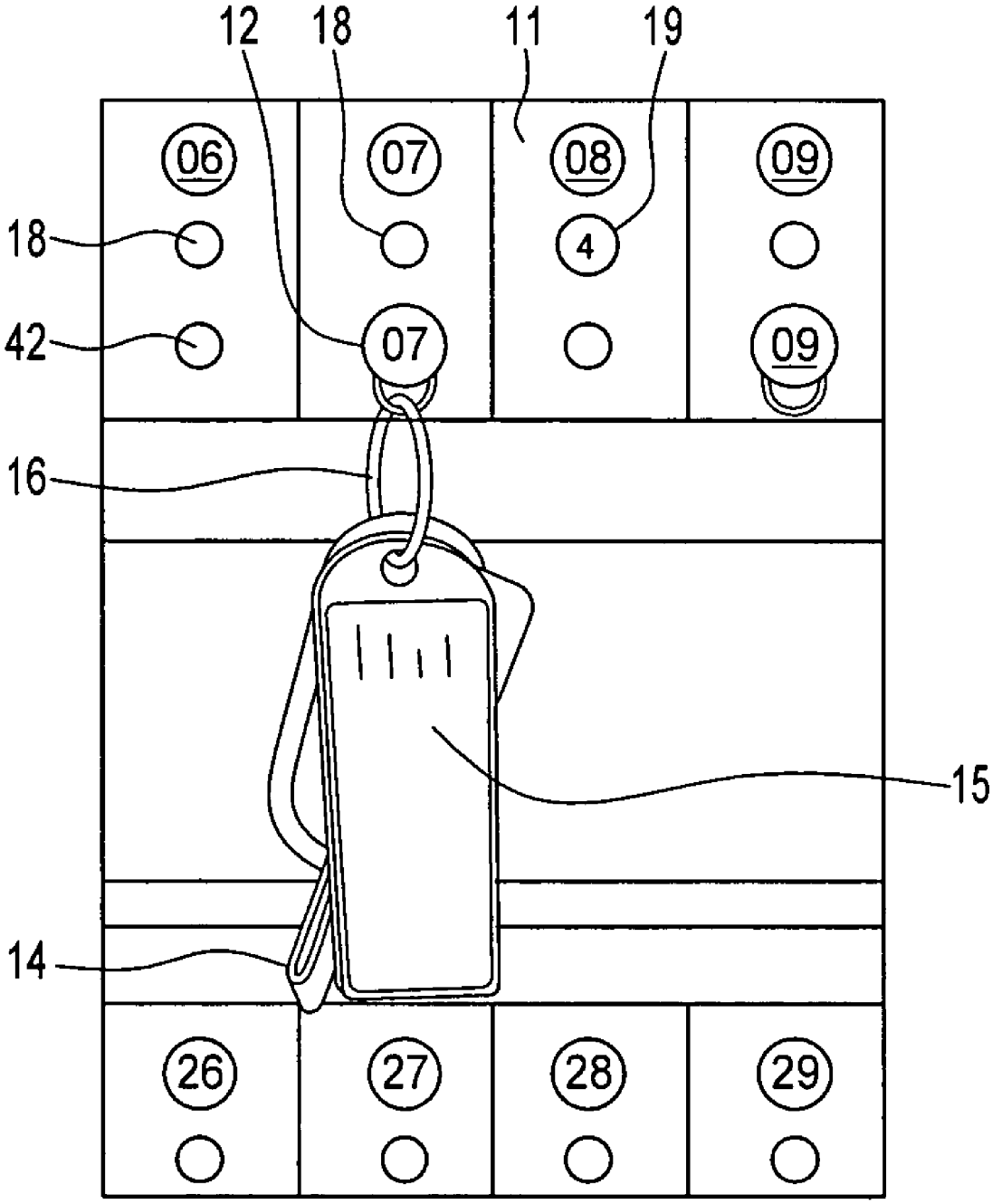
FIG. 2 is a detail view of a portion of the key control and storage cabinet shown in FIG. 1.

With reference to FIGS. 1 and 2, a key control storage cabinet 10 has an array of control units 11, each having a unique numerical identifier 41 on front panel 40 and an opening 42 for receiving a correspondingly numbered key holding element 12, to which can be attached a key ring 16 having a key 14 and an identification tag 15 (FIG. 2). In the example shown, the control units 11 are numbered consecutively 1 to 40. Associated with each key holding element-receiving opening 42 is an access control key receiving opening 18 (FIG. 2) for receiving an access control key 19. When not in use the access control keys can be stored in an array of openings 13 marked with employee names.

Figure 3:
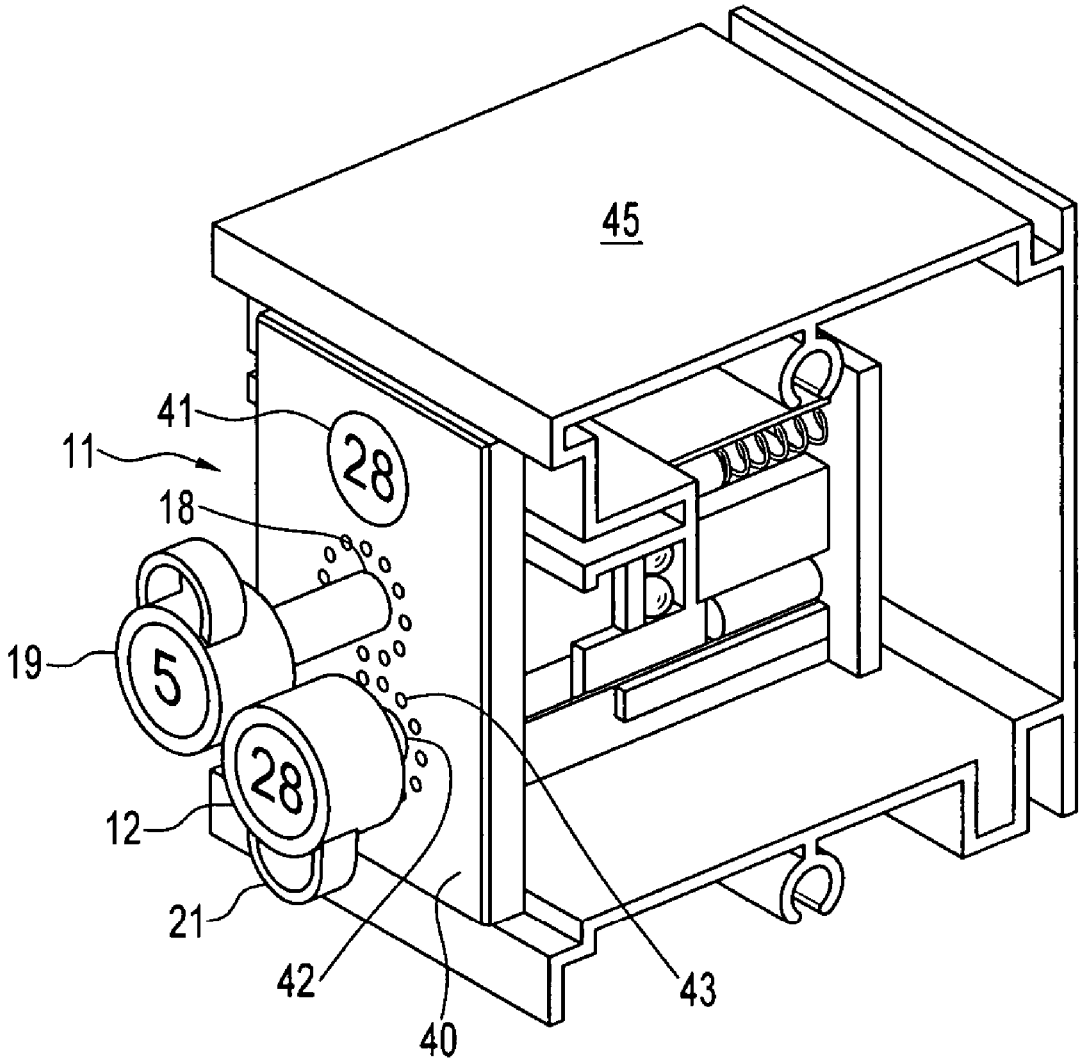
FIG. 3 is a perspective cross-sectional view of a key control unit according to the invention.
Figure 4:
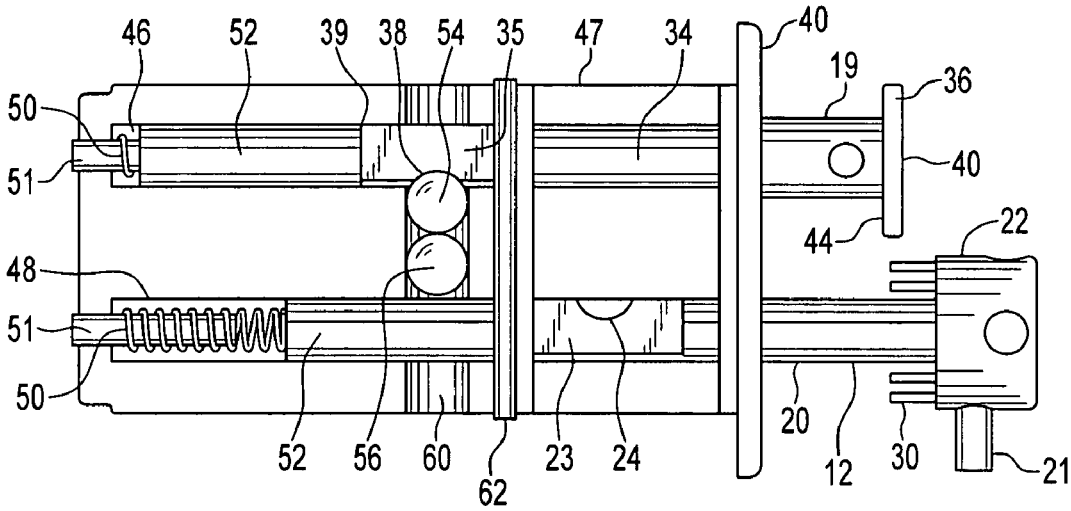
FIG. 4 is a side cut-away view of a key control unit according to the invention.
Figure 9:
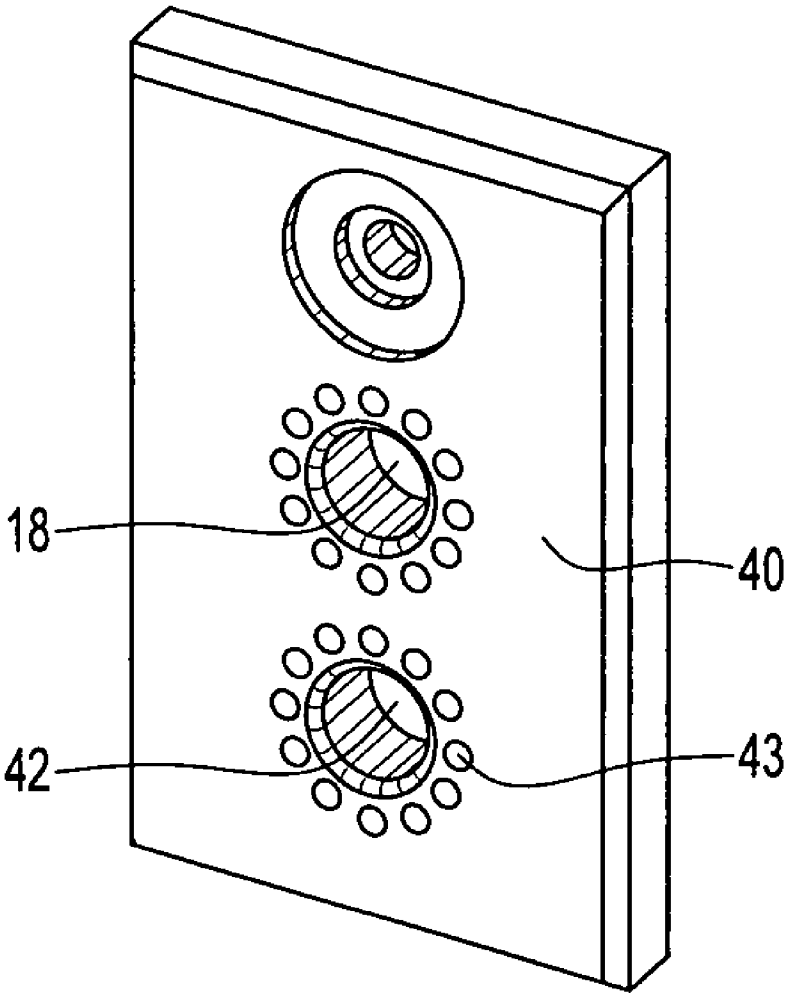
FIG. 9 is a front perspective view of the faceplate of a control unit according to the invention.

As shown in FIGS. 2 and 3, each control unit 11 is mounted in an elongated extruded aluminum frame 45 and has a front panel 40 having numerical identifier 41, and openings 18 and 42 which receive respectively shank 34 of access control key 19 and the shank 20 of key holder 12 (see FIG. 4). Opening 42 has an array of holes 43 around it, as shown also around opening 18 (FIG. 9), only selected ones of which holes extend completely through the face plate 40 in order to match the unique configuration of pins 30 on one of the key holders 12.

Figure 5:
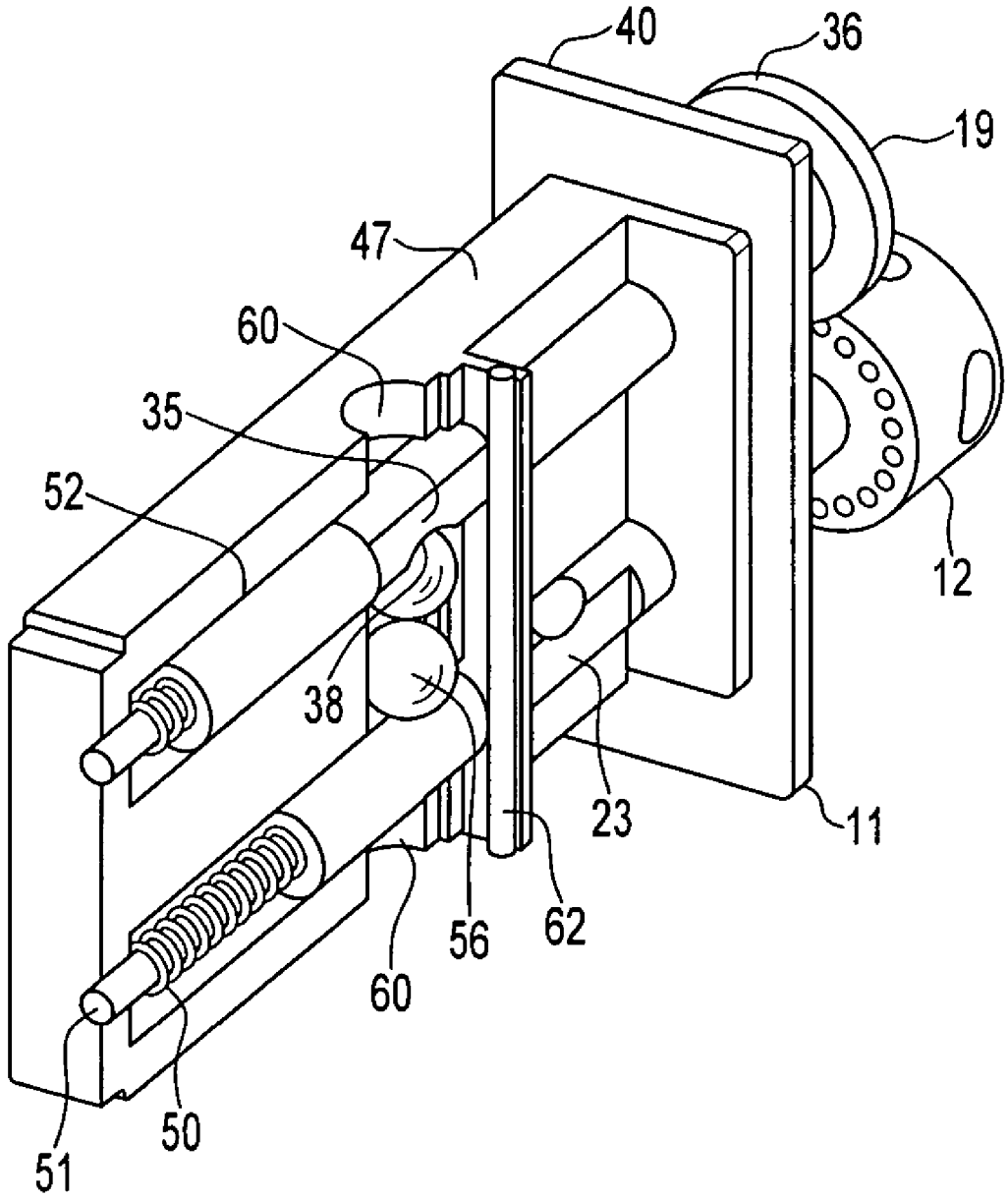
FIG. 5 is a rear perspective cut-away view of a key control unit according to the invention.

With reference to FIGS. 4 and 5, openings 18, 42 communicate with cylindrical channels 46, 48 in housing 47 of control unit 11. Channels 46, 48 each has a spring 50 and a sliding cylinder 52 located therein. Springs 50 are maintained in place by posts 51. Each control unit 11 has a central vertical passage 60 which holds two freely-moving ball bearings 54, 56. Ball bearings 54, 56 are sized to fit in hemispherical cut-outs 24, 38 of key holder 12 and access control key 19 respectively, as described further below. A bar or plate 62 extends across channels 46, 48 to block the passage of sliding cylinders 52 but permit the passage of the half-round ends 25, 39 of shanks 34 and 20 of key holder 12 and access control key 19 respectively.

Figure 6:
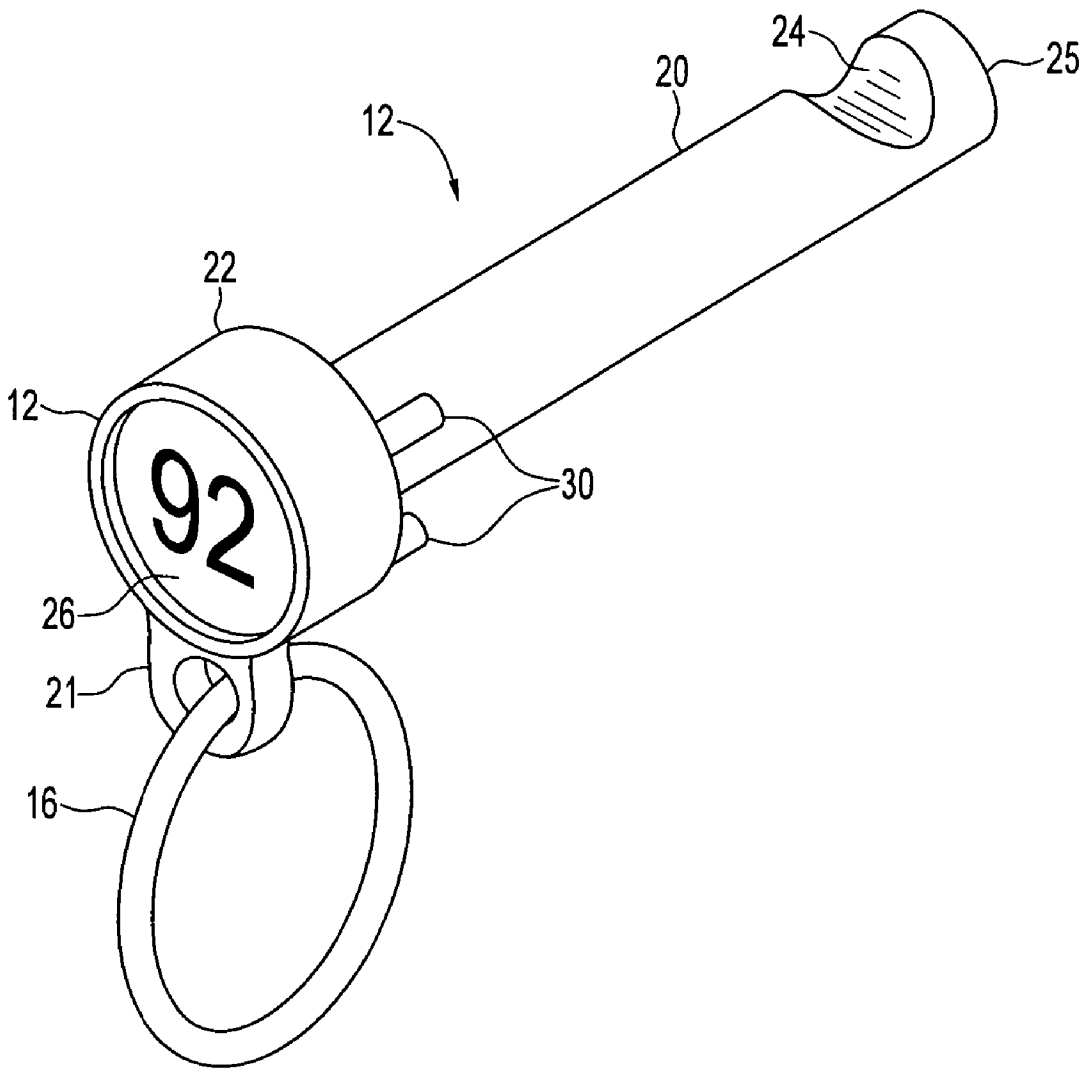
FIG. 6 is a perspective view of a key holding element according to the invention.
Figure 7:
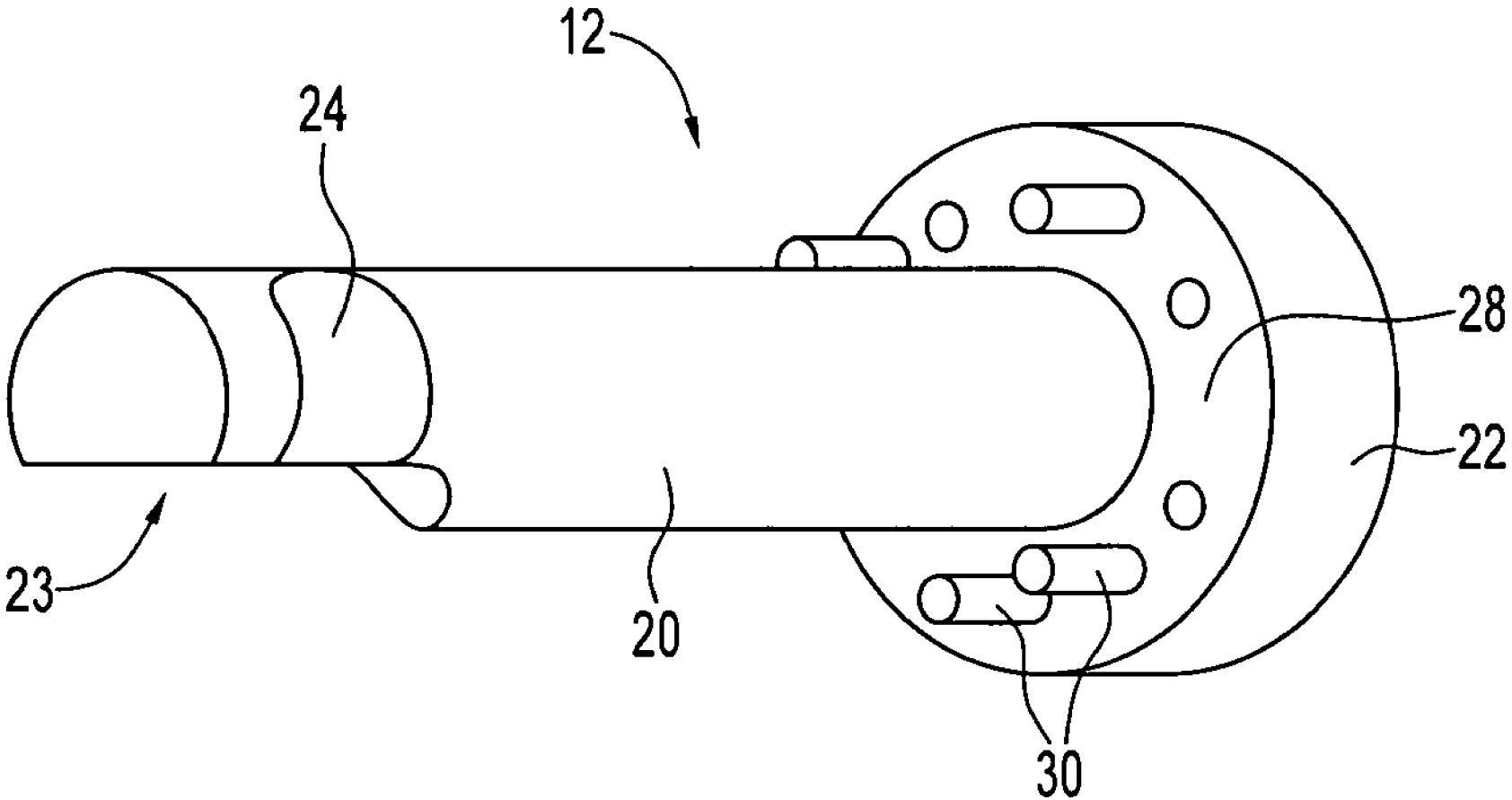
FIG. 7 is a rear perspective of a key holding element according to the invention.

As shown in FIGS. 6 and 7, each key holder 12 comprises a cylindrical shank 20 and cylindrical head 22 having a diameter larger than shank 20 and a ring 21 for attaching a key ring. Shank 20 has a hemispherical cut-out 24 on the upper surface thereof adjacent end 25. The end 25 of shank 20 furthest from head 22 is half-round, being cut away to form a flat surface 23. Head 22 has a flat number-bearing surface 26 and a rear surface 28 from which project four pins 30.

Similarly, as shown in FIGS. 4 and 5, each access control key 19 comprises a cylindrical shank 34 and cylindrical head 36 having a diameter larger than shank 34. Shank 34 has a hemispherical cut-out 38 adjacent end 39. The end 39 of shank 34 farthest from head 36 is half-round, being cut away to form a flat surface 35. Head 36 has a flat identification-bearing surface 40, to display a unique number corresponding to an individual, and a rear surface 44 but unlike key holder 12 there are no pins projecting from surface 44.

Figure 8:
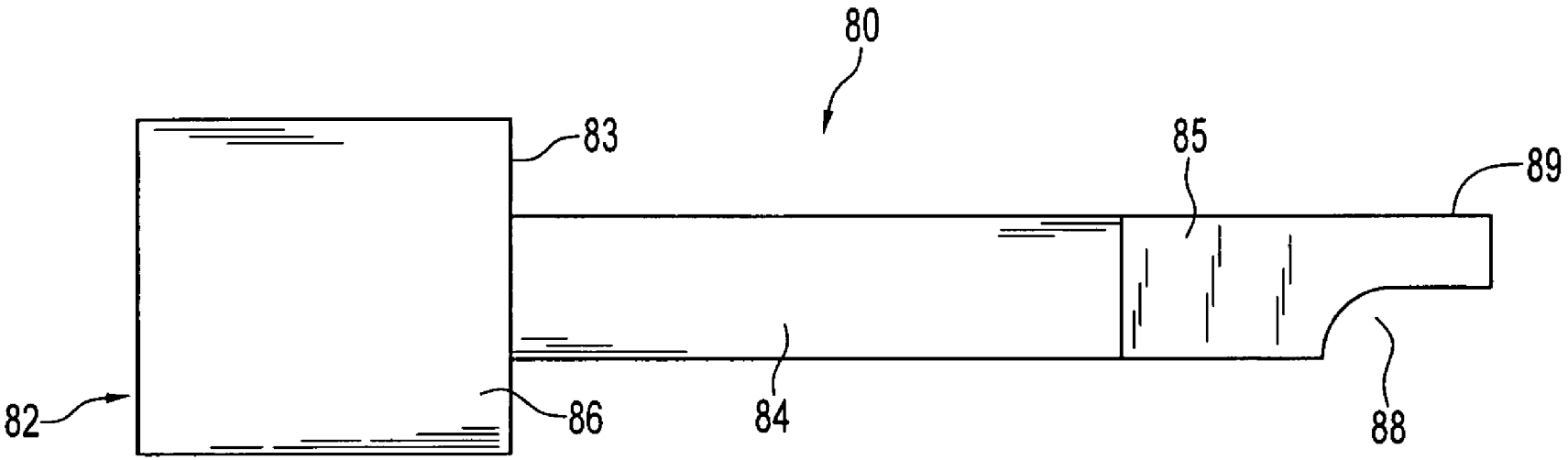
FIG. 8 is an elevation view a master key element according to the invention.

As shown in FIG. 8 a master access key 80 can also be provided. It is generally the same in features and dimensions as the access control key 19. It comprises a cylindrical shank 84 and cylindrical head 86 having a diameter larger than shank 84. The end 89 of shank 84 furthest from head 86 is half-round, being cut away to form a flat surface 85. Shank 84 has a cut-out 88 adjacent end 89 but unlike cut-out 38 in access control key 19, it is cut-out right to the end of end 89 so tat the master key is not retained by ball bearing 54. Head 86 has a flat identification-bearing surface 82 to identify it as a master key, and a rear surface 83 but again unlike key holder 12 there are no pins projecting from surface 83.

In operation, a key holding element 12 is removed from cabinet 10 using a master access key 80, and key 14 is attached to the key holding element 12 along with an identification tag 15 which identifies the customer, type of vehicle, license no. etc. The key holding element 12 is then returned to cabinet 10, and then cannot be removed due to spring 50 biasing sliding cylinder 52 in position whereby ball bearing 56 extends into the hemispherical cut-out 24 of key holder 12. Each key holder 12 can only be received in one unique control element 11 due to the configuration of pins 30 and the half-round end 25 of shank 20. When a uniquely numbered access control key 19 is inserted into opening 42 it compresses spring 50 and ball bearing 54 is pushed into hemispherical cut-out 38, and ball bearing 56 is forced out of cut-out 24 as key holder 12 is pushed out of channel 48 by spring 50, and can then be removed from control unit 11. Access control key 19 cannot now be removed from control unit 11 due to the biasing of spring 50 causing sliding cylinder 52 to hold ball bearings 54, 56 in place. Access control key 19 can only be removed similarly when the unique key holder 12 corresponding to that control unit 11 is replaced. By putting a unique identifier such as a number or initials on face 40 a manager can identify which individual has possession of the key which has been removed from a particular control unit 11. Even if a second access key 19 is inserted into opening 42 while an access key 19 is in opening 18, the latter cannot be removed since the cut-away 38 on the second access key will not be in position to interact with ball bearing 56 when the half-round end is appropriately oriented to by-pass plate 62. Thus the manager will know which individual employee has control of the key in question.

As an alternate procedure, the manager may use the master key 80 first thing in the day to remove all key holders 12 from the cabinet and then replace them as keys are left by customers during the day.

In order to facilitate manufacture of the unique pin 30 configurations, face plate 40 can be injection molded having the array of 12 holes partially penetrating the face plate but for a thin wall of plastic which can then be removed by hand in the desired locations to match the configurations of pins 30 on key holders 12. 100 unique pin configurations can be provided using 4 pins, by varying the position of 2 pins in one of 5 holes on one half of the circumference to provide the first digit from 0 to 9 and the second digit from 0 to 9 is then provided by varying the position of the other 2 pins in one of 5 holes on the other half of the circumference.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A key control apparatus comprising a plurality of key control units, each said key control unit comprising:

i) a unique key holding element corresponding to said key control unit comprising a head adapted to have a key removably attached thereto and an elongated shaft connected to said head; and ii) an access control element comprising an elongated shaft;

wherein each said key control unit further comprises a cylindrical key holding element passage having a closed end and an open end and a diameter less than the head of said unique key holding element for alternately receiving and releasing said shaft of said key holding element and a cylindrical access control element passage parallel to said key holding element passage having a closed end and an open end for alternately receiving and releasing said shaft of said access control element; biasing means located in said key holding element passage and said access control element passage adjacent the closed ends thereof and adapted to bias said key holding element and said access control element out of said passages when said elements are inserted thereinto;

reciprocating means for movement in a direction perpendicular to said key holding element passage and said access control element passage between a first position, extending into said key holding element passage but not extending into said access control element passage and a second position extending into said access control element passage but not extending into said key holding element passage, whereby when said shaft of said key holding element is inserted into said key holding element passage, said reciprocating means is in said first position and engages and retains said key holding element in said key holding element passage while said access control element is biased out of said access control element passage, and when said shaft of said access control element is inserted into said access control element passage, said reciprocating means is in said second position and engages and retains said access control element in said access control element passage while said key holding element is biased out of said key holding element passage, and wherein said reciprocating means is moved by the force of said biassing means acting through one of said key holding element or said access control element to move said reciprocating means in a direction perpendicular to the direction of motion of said key holding element or said access control element;

whereby said unique key holding element can be removed from said key control unit by inserting said access control element into said access control element passage but said access control element can only be removed when said unique corresponding key holding element is inserted into said control unit.

2. A key control apparatus according to claim 1 wherein each said key control unit is uniquely marked to correspond to said corresponding unique key holding element.

3. A key control apparatus according to claim 2 wherein each said key control unit is adapted for receiving a unique one of said key holding elements by providing a unique array of pin-receiving holes in the surface of said key control unit adjacent said open end of said key holding element passage corresponding to a complementary pattern of pins on the head of said corresponding key holding element.

4. A key control apparatus according to claim 1 wherein said reciprocating means comprise a plurality of ball bearings.

5. A key control apparatus according to claim 4 wherein said shafts of said key holding elements and said access control elements are each notched adjacent the ends thereof and at opposed locations to alternately receive one of said plurality of ball bearings.

6. A key control apparatus according to claim 1 comprising a cylindrical element disposed in each of said key holding element passage and said access control element passage between said biassing means and said open end of each said passages, and wherein a stop means extends across said key holding element passage and said access control element passage between said reciprocating means and said open ends of said passages whereby said cylindrical elements are prevented from passing said stop means in the direction of said open ends of said passages and the ends of said shafts of said key holding element and said access control element are adapted to pass said stop means in the direction of said closed ends of said passages to engage said cylindrical elements.

7. A key control apparatus according to claim 6 wherein said ends of said shafts of said key holding element and said access control element are adapted to pass said stop means in the direction of said closed ends of said passages to engage said cylindrical elements by said shafts being cut away at the distal ends thereof to pass said stop means.

8. A method of controlling keys comprising:

i) providing a key control apparatus comprising a plurality of key control units, each said key control unit comprising:

a) a unique key holding element corresponding to said key control unit comprising a head adapted to have a key removably attached thereto and an elongated shaft connected to said head; and b) an access control element comprising an elongated shaft connected to a head;

each control unit having a passage for receiving a unique one of said key holding elements and a passage for receiving any one of said access control elements; whereby said unique key holding element can be removed from said corresponding key control unit by inserting said access control element into said passage but said access control element can only be removed when said unique corresponding key holding element is inserted into said corresponding key control unit;

ii) providing each said key control unit with a unique marking to correspond to a corresponding marking on said unique key holding element; and wherein each said key control unit is adapted for receiving a unique one of said key holding elements by providing a unique array of pin-receiving holes in the surface of said key control unit adjacent an open end of said key holding element passage corresponding to a complementary pattern of pins on the head of said corresponding key holding element.

* * * * *